US011220987B2

(12) United States Patent
Iwa et al.

(10) Patent No.: US 11,220,987 B2
(45) Date of Patent: Jan. 11, 2022

(54) METAL DIAPHRAGM DAMPER

(71) Applicant: Eagle Industry Co., Ltd., Tokyo (JP)

(72) Inventors: Toshiaki Iwa, Tokyo (JP); Yoshihiro Ogawa, Tokyo (JP); Yusuke Sato, Tokyo (JP)

(73) Assignee: EAGLE INDUSTRY CO., LTD.

( * ) Notice: Subject to any disclaimer, the term of this patent is extended or adjusted under 35 U.S.C. 154(b) by 0 days.

(21) Appl. No.: 16/762,111

(22) PCT Filed: Nov. 20, 2018

(86) PCT No.: PCT/JP2018/042765
§ 371 (c)(1),
(2) Date: May 6, 2020

(87) PCT Pub. No.: WO2019/102982
PCT Pub. Date: May 31, 2019

(65) Prior Publication Data

US 2020/0355150 A1 Nov. 12, 2020

(30) Foreign Application Priority Data

Nov. 24, 2017 (JP) ..... JP2017-225530

(51) Int. Cl.
*F02M 59/44* (2006.01)
*F02M 59/36* (2006.01)
(Continued)

(52) U.S. Cl.
CPC ..... *F02M 55/04* (2013.01); *F02M 37/00* (2013.01); *F02M 59/366* (2013.01);
(Continued)

(58) Field of Classification Search
CPC .. F02M 55/04; F02M 59/44; F02M 2200/315; F02M 59/48; F02M 37/0041; F04B 43/02; F16J 3/02
(Continued)

(56) References Cited

U.S. PATENT DOCUMENTS 5,743,170 A 4/1998 Pascual et al. ..... 92/103
7,004,733 B2 * 2/2006 Schepp ..... B60T 8/4031 417/470
(Continued)

FOREIGN PATENT DOCUMENTS

CN 1219993 6/1999 ..... F01B 19/00
CN 107002615 8/2017 ..... F02N 59/44
(Continued)

OTHER PUBLICATIONS

"Development of optimal diaphragm-based pulsation damper structure for high-pressure GDI pump systems through design of experiments"; NPL Scientific Journal Publication; Retreived from the internet Sep. 2, 2021; URL:https://www.sciencedirect.com/science/article/pii/S0957415813000238 (Year: 2013).*
(Continued)

*Primary Examiner* — Sizo B Vilakazi
*Assistant Examiner* — Brian R Kirby
(74) *Attorney, Agent, or Firm* — Hayes Soloway P.C.

(57) ABSTRACT

Disclosed is a metal diaphragm damper that is hard to fracture even when repeated stress is applied thereto. A disk-shaped metal diaphragm damper is provided with diaphragms each having a deformable portion provided at the center and an outer circumferential fixation portion formed by outer circumferential rims of the diaphragms and that is filled with gas. The deformable portion has a third curved portion located at the radially outward side thereof and formed to be bulged; a first curved portion located radially
(Continued)

inward of the third curved portion and formed to be bulged out; and a second curved portion located between the third curved portion and the first curved portion. The second curved portion includes at least one curved wall part which is formed to be dented in.

14 Claims, 7 Drawing Sheets

(51) Int. Cl.
*F02M 37/00* (2006.01)
*F02M 55/04* (2006.01)

(52) U.S. Cl.
CPC ..... *F02M 59/44* (2013.01); *F02D 2200/0602* (2013.01); *F02M 2200/315* (2013.01); *F02M 2200/8084* (2013.01)

(58) Field of Classification Search
USPC ..... 417/540, 395; 123/446, 495, 447, 506, 123/467
See application file for complete search history.

(56) References Cited

U.S. PATENT DOCUMENTS 8,366,421 B2 * 2/2013 Munakata ..... F02M 59/367 417/540
8,562,315 B2 * 10/2013 Inoue ..... F02M 63/0265 417/540
8,727,752 B2 * 5/2014 Lucas ..... B27B 21/04 417/541
8,757,212 B2 * 6/2014 Bartsch ..... B60T 8/42 138/30
8,955,550 B2 * 2/2015 Oikawa ..... F02M 59/06 138/30
9,057,348 B2 * 6/2015 Usui ..... F02M 55/04
9,828,988 B2 * 11/2017 Koehler ..... F02M 59/44
10,480,466 B2 11/2019 Tomitsuka et al. ..... F02M 37/0041
10,480,704 B2 * 11/2019 Yoshida ..... F02M 55/00
10,544,768 B2 * 1/2020 Kashiwagi ..... F02M 59/44
10,753,331 B2 * 8/2020 Iwa ..... F16F 1/048
2002/0153209 A1 * 10/2002 Nagy ..... F16F 9/04 188/73.37
2003/0164161 A1 * 9/2003 Usui ..... F02M 59/366 123/510
2005/0019188 A1 * 1/2005 Usui ..... F02M 59/366 417/540
2006/0272144 A1 * 12/2006 Matsuki ..... B23K 26/125 29/463
2008/0289713 A1 11/2008 Munakata et al. ..... 138/26
2010/0215529 A1 8/2010 Inoue ..... F04B 45/00
2014/0193280 A1 * 7/2014 Saito ..... F02M 21/0245 417/540
2015/0260133 A1 * 9/2015 Iwa ..... F02M 37/0041 92/47
2016/0169173 A1 * 6/2016 Yabuuchi ..... F02M 59/44 417/274
2016/0298581 A1 10/2016 Nah et al. ..... F02M 37/0041
2017/0335810 A1 11/2017 Tomitsuka et al. ..... F02M 37/0041
2018/0171992 A1 * 6/2018 Saito ..... F02M 59/44
2018/0274525 A1 * 9/2018 Schretling ..... F04B 11/00
2019/0063388 A1 * 2/2019 Kurt ..... F02M 55/04
2019/0152455 A1 * 5/2019 Kai ..... B60T 17/00

FOREIGN PATENT DOCUMENTS

DE 10 2014 219 997 4/2016 ..... F04B 11/00
DE 10 2015 219 537 4/2017 ..... F04B 11/00
DE 10 2015 219 768 4/2017 ..... F02M 55/04
JP 2016-113922 6/2016 ..... F02M 59/44
JP WO2017195415 A1 * 11/2017
WO WO2017195415 11/2017 ..... B06T 17/00

OTHER PUBLICATIONS

International Search Report and Written Opinion issued inPCT/JP2018/042765, dated Feb. 12, 2019, with English translation, 15 pages.
International Preliminary Report on Patentability issued in PCT/JP2018/042765, dated May 26, 2020. 5 pages.
Supplemental European Search Report issued in corresponding European Patent Application No. 18882045.0, dated Jun. 15, 2021, 7 pages.
Chinese Official Action issued in related Chinese Patent Application Serial No. 201880073747.6, dated Jun. 1, 2021 (17 pages).

* cited by examiner (a)

(b) PRIOR ART

METAL DIAPHRAGM DAMPER

TECHNICAL FIELD

The present invention relates to a metal diaphragm damper for absorbing pulsation, which is used in a location where pulsation occurs in a high-pressure fuel pump or the like.

BACKGROUND ART

Conventionally, at the time of driving an engine or the like, a high-pressure fuel pump is used to pump fuel supplied from a fuel tank toward an injector. The high-pressure fuel pump is configured to pressurize and discharge the fuel by reciprocating movement of a plunger driven by rotation of a camshaft of an internal combustion engine.

The conventional mechanism for pressurizing and discharging the fuel in the high-pressure fuel pump is as below. First, when the plunger moves downward, a suction process is performed in which a suction valve is opened to suck the fuel from a fuel chamber formed adjacent to a fuel inlet into a pressurizing chamber. Next, when the plunger moves upward, a volume adjustment process of returning a portion of the fuel in the pressurizing chamber to the fuel chamber is performed. Then, the suction valve is closed; thereafter, when the plunger moves further upward, a pressurizing process of pressurizing the fuel is performed. As just described, the high-pressure fuel pump repeats the cycle of the suction process, the volume adjustment process, and the pressurizing process and thus pressurizes the fuel to discharge the fuel toward the injector. At this time, pulsation is generated in the fuel chamber by a change in the discharge volume of the fuel discharged from the high-pressure fuel pump to the injector or a change in the injection volume of the injector.

A metal diaphragm damper configured to reduce pulsation occurring in the fuel chamber is internally disposed in such a high-pressure fuel pump. For example, as illustrated in FIG. 7, a metal diaphragm damper described in Patent Citation 1 is disposed in a fuel chamber and is formed in a disk shape, which is obtained by connecting radially outward end portions of two disk plate-shaped diaphragms and into which gas at a predetermined pressure is filled. The metal diaphragm damper includes a deformable portion in the center thereof, and when the fuel pressure associated with pulsation is received by the deformable portion, the deformable portion is elastically deformed; therefore, the volume of the fuel chamber varies to reduce the pulsation.

As illustrated in FIG. 7A, the deformable portion of the diaphragm includes: a first curved portion 101 having a large curvature radius (R101) and located at the center thereof so as to bulge out; and a second curved portion 102 continuously radially outward formed from the first curved portion 101 and having a curvature radius (R102) smaller than that of the first curved portion 101 so as to bulge out. The metal diaphragm damper further includes an outer circumferential fixation portion forming an outer circumferential rim thereof. The outer circumferential fixation portion is supported by a support member, and thus the metal diaphragm damper is fixed in the fuel chamber (not illustrated).

Thus, the diaphragm described in Patent Citation 1 is designed such that the first curved portion 101 bulging out is disposed at the center of the meal diaphragm damper to secure a large elastic deformation allowance. Accordingly, when the first curved portion 101 is axially deformed by external pressure (e.g., fuel pressure), a radially outward end portion of the first curved portion 101 is deformed to radially outward expand. Then, the radially outward stress generated by the radially outward deformation of the first curved portion 101 acts on the second curved portion 102; therefore, the second curved portion 102 is deformed radially outward. Consequently, the stress acts on the diaphragm is dispersed.

CITATION LIST

Patent Literature

Patent Citation 1: JP 2016-113922 A (page 5, FIG. 3)

SUMMARY OF INVENTION

Technical Problem

Here, the metal diaphragm damper disclosed in the Patent Citation 1 is configured such that the first curved portion 101 at the radially inward side of the diaphragm has the large curvature radius and thus is easily deformed axially and such that the second curved portion 102 at the radially outward side is located adjacent to the outer circumferential fixation portion and has the small curvature radius and thus is not easily deformed axially compared with the first curved portion 101. In addition, the first curved portion 101 and the second curved portion 102 are formed in curved shapes protruding outward, and when being deformed axially, the first curved portion 101 is deformed to radially expand. Accordingly, when the first curved portion 101 is deformed radially outward under external pressure, stress may concentrate on a periphery P1 around a flexion point between the first curved portion 101 and the second curved portion 102 or a boundary periphery P2 between the second curved portion 102 and the outer circumferential fixation portion. Consequently, the diaphragm may be fractured by pulsation repeating high pressure and low pressure. Moreover, when the external force is large, the second curved portion 102 may be partially reversed (see FIG. 7B); therefore, the diaphragm may be fractured.

The present invention is thus made in view of such a problem, and an object of the present invention is to provide a metal diaphragm damper which is hard to fracture even when being applied with repeated stress.

Solution to Problem

To solve the foregoing problem, a metal diaphragm damper according to a first aspect of the present invention includes a diaphragm including: a deformable portion disposed in a center thereof; and an outer circumferential fixation portion formed by an outer circumferential rim of the diaphragm, the metal diaphragm damper being filled with gas inside and formed in a disk shape. The deformable portion includes: a third curved portion located at a radially outward side thereof and formed to be bulged out; a first curved portion located radially inward of the third curved portion and formed to be bulged out; and a second curved portion located between the first curved portion and the third curved portion. The second curved portion includes at least a curved wall part formed to be dented in.

According to the first aspect, the second curved portion includes the curved wall part formed to be dented in. Accordingly, the second curved portion is deformed inward of the diaphragm in accordance with deformation of the first curved portion under external pressure; therefore, stress acting inward of the diaphragm is applied to the radially inward side of the third curved portion by the deformation of the second curved portion to deform the third curved portion such that the curvature radius thereof is reduced. Consequently, the diaphragm absorbs radially outward stress generated by the deformation of the first curved portion. Thus, the stress is inhibited from concentrating on the third curved portion and the surroundings around a boundary between the third curved portion and the outer circumferential fixation portion. As a result, the metal diaphragm damper can be effectively prevented from being fractured. In addition, the stress to reduce the curvature radius acts on the third curved portion; therefore, the third curved portion is not easily reversed. As a result, the metal diaphragm damper can be effectively prevented from being fractured.

In a second aspect of the present invention, the second curved portion consists of the curved wall part.

According to the second aspect, a large region of variable volume can be secured in the center of the diaphragm.

In a third aspect of the present invention, the curved wall part of the second curved portion is formed so as to have a curvature radius smaller than a curvature radius of a curved wall part forming the third curved portion.

According to the third aspect, the third curved portion can be easily deformed radially outward, and the second curved portion having the curved wall part formed to be dented in can be prevented from being axially and largely deformed.

In a fourth aspect of the present invention, the diaphragm is connected to another diaphragm such that the metal diaphragm damper is constituted by a pair of diaphragms having an identical shape and reversely oriented to each other, and the outer circumferential rims of the diaphragms are fixed to each other so as to form the outer circumferential fixation portion.

According to the fourth aspect, the respective diaphragms can absorb pulsation, and thus the metal diaphragm damper can sufficiently secure pulsation absorption performance.

In a fifth aspect of the present invention, the second curved portion has a point defining a shortest distance from the curved wall part of the second curved portion to the outer circumferential fixation portion in an axial direction is larger than a maximum length of deformation of the first curved portion in the axial direction.

According to the fifth aspect, even when the first curved portions of the pair of diaphragms are respectively deformed to the maximum, the points of the second curved portions defining the shortest distances are not brought into contact with each other. Therefore, the pair of diaphragms may not be fractured.

In a sixth aspect of the present invention, a radially inward distance between the point of the second curved portion and another point of the second curved portion opposite to each other over the center of the diaphragm is larger than a radially outward distance from each of the points of the second curved portion to a radially outward end of the third curved portion.

According to the sixth aspect, the first curved portion functions as the region of variable volume and the third curved portion functions as a stress absorption region. Accordingly, the radial dimension of the first curved portion is set to be larger than that of the third curved portion, and thus the region of large variable volume can be secured.

BRIEF DESCRIPTION OF DRAWINGS

FIGS. 7A and 7B are cross-sectional views respectively illustrating the structure of the metal diaphragm damper under low pressure surroundings and the structure of the metal diaphragm damper pressurized under high pressure surroundings.

DESCRIPTION OF EMBODIMENTS

Modes for carrying out a metal diaphragm damper according to the present invention will be described below based on embodiments.

Embodiments

A metal diaphragm damper according to an embodiment of the present invention will be described with reference to FIGS. 1 to 6.

Figure 1:
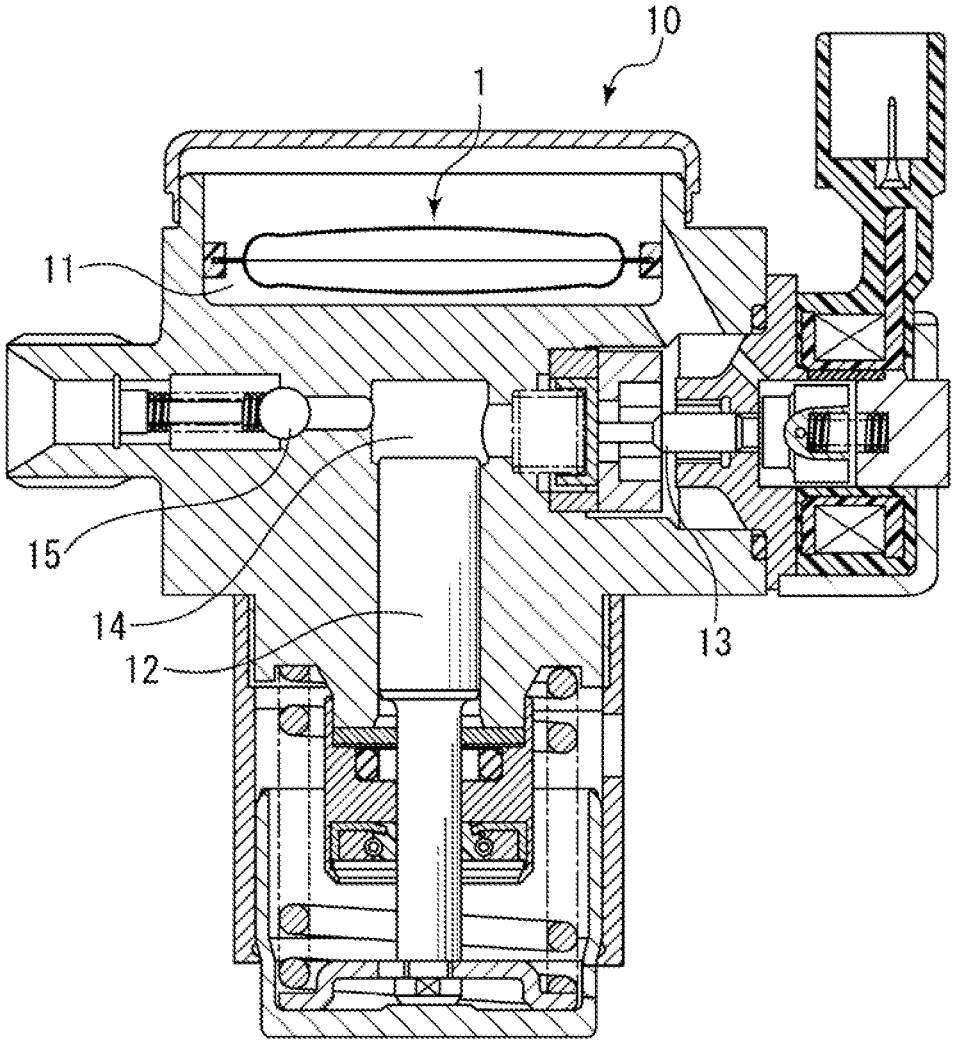
FIG. 1 is a cross-sectional view illustrating a high-pressure fuel pump in which a metal diaphragm damper according to an embodiment of the present invention is internally disposed.

As illustrated in FIG. 1, a metal diaphragm damper 1 according to the embodiment is internally disposed in a high-pressure fuel pump 10 configured to pump fuel supplied from a fuel tank through a fuel inlet (not illustrated) toward an injector. The high-pressure fuel pump 10 is configured to pressurize and discharge the fuel by reciprocating movement of a plunger 12 driven by rotation of a camshaft (not illustrated) of an internal combustion engine.

The mechanism for pressurizing and discharging the fuel in the high-pressure fuel pump 10 is as below. First, when the plunger 12 moves downward in FIG. 1, a suction process is performed in which a suction valve 13 is opened to suck the fuel from a fuel chamber 11 formed adjacent to a fuel inlet into a pressurizing chamber 14. Next, when the plunger 12 moves upward, a volume adjustment process of returning part of the fuel in the pressurizing chamber 14 to the fuel chamber 11 is performed. Then, the suction valve 13 is closed; thereafter, when the plunger 12 moves further upward, a pressurizing process of pressurizing the fuel is performed.

As just described, the high-pressure fuel pump 10 repeats the cycle of the suction process, the volume adjustment process, and the pressurizing process and thus pressurizes the fuel and opens a discharge valve 15 to discharge the fuel toward the injector. At this time, pulsation repeating high-pressure and low-pressure is generated in the fuel chamber 11 by a change in the discharge volume of the fuel discharged from the high-pressure fuel pump 10 to the injector or a change in the injection volume of the injector. The metal diaphragm damper 1 is used to reduce the pulsation occurring in the fuel chamber 11 of the high-pressure fuel pump 10 as just described.

Figure 2:
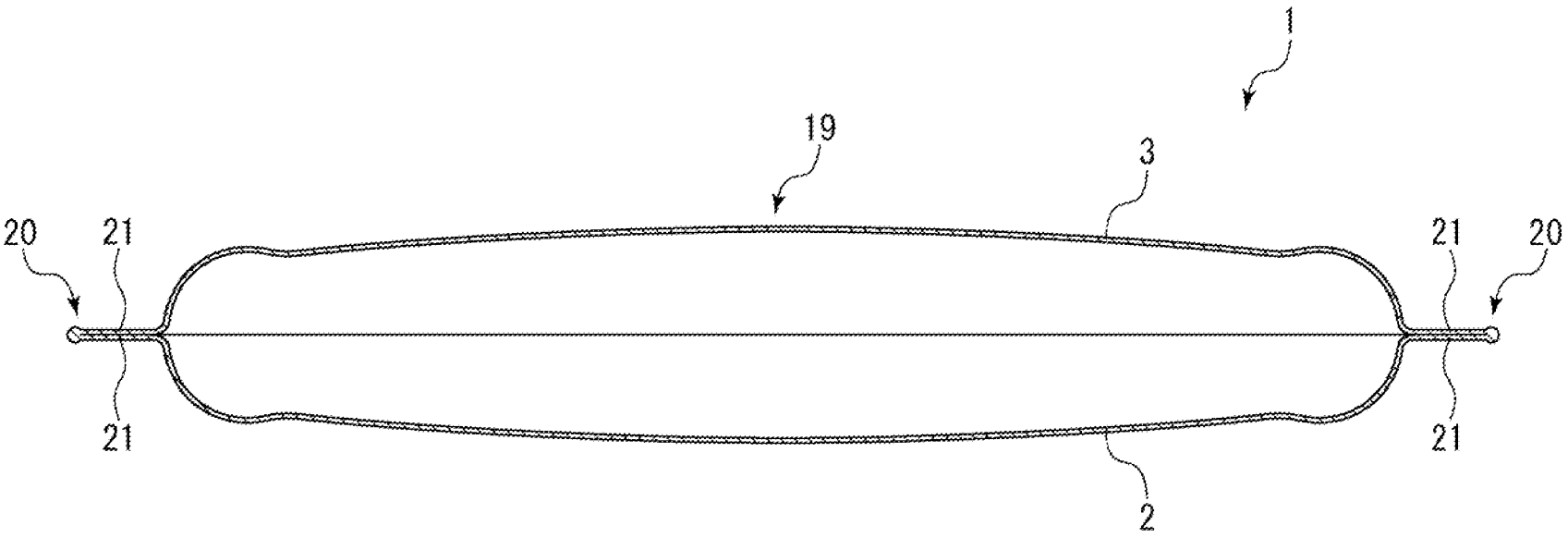
FIG. 2 is a cross-sectional view illustrating the metal diaphragm damper according to the embodiment of the present invention.

As illustrated in FIG. 2, the metal diaphragm damper 1 is configured in such a way that a pair of diaphragms, i.e., a diaphragm 2 and a diaphragm 3 are connected to each other. As described below, outer circumferential rims of the two diaphragms 2, 3 are entirely and circumferentially fixed to each other in an airtight manner by laser welding.

Gas made of argon and helium or the like at a predetermine pressure is filled in an enclosed space formed between the connected diaphragms 2 and 3 (i.e., inside the metal diaphragm damper 1). In addition, the metal diaphragm damper 1 adjusts a change in the volume by inner pressure of the gas filled in the enclosed space and thus can obtain a desired pulsation absorption performance.

The diaphragms 2, 3 are formed by pressing a metallic plate of the same material into the same dish shape, and thus the diaphragms 2, 3 have substantially the same shape and thickness, the thickness being entirely uniform. A deformable portion 19 is formed in the center of each of the diaphragms 2, 3, and a connection end portion 21 is formed by an outer circumferential rim of each of the diaphragms 2, 3. The connection end portion 21 of the diaphragm 2 and the connection end portion 21 of the diaphragm 3 are configured such that parallel portions thereof are entirely and circumferentially connected in an airtight manner by laser welding, thereby forming an outer circumferential fixation portion 20.

Herein, the diaphragms 2, 3 will be described in detail; however, in the descriptions related to the diagrams in FIGS. 3 to 5, for convenience, the diaphragm 2 will be described and the description about the diaphragm 3 having the same structure as the diaphragm 2 will be omitted.

Figure 3:
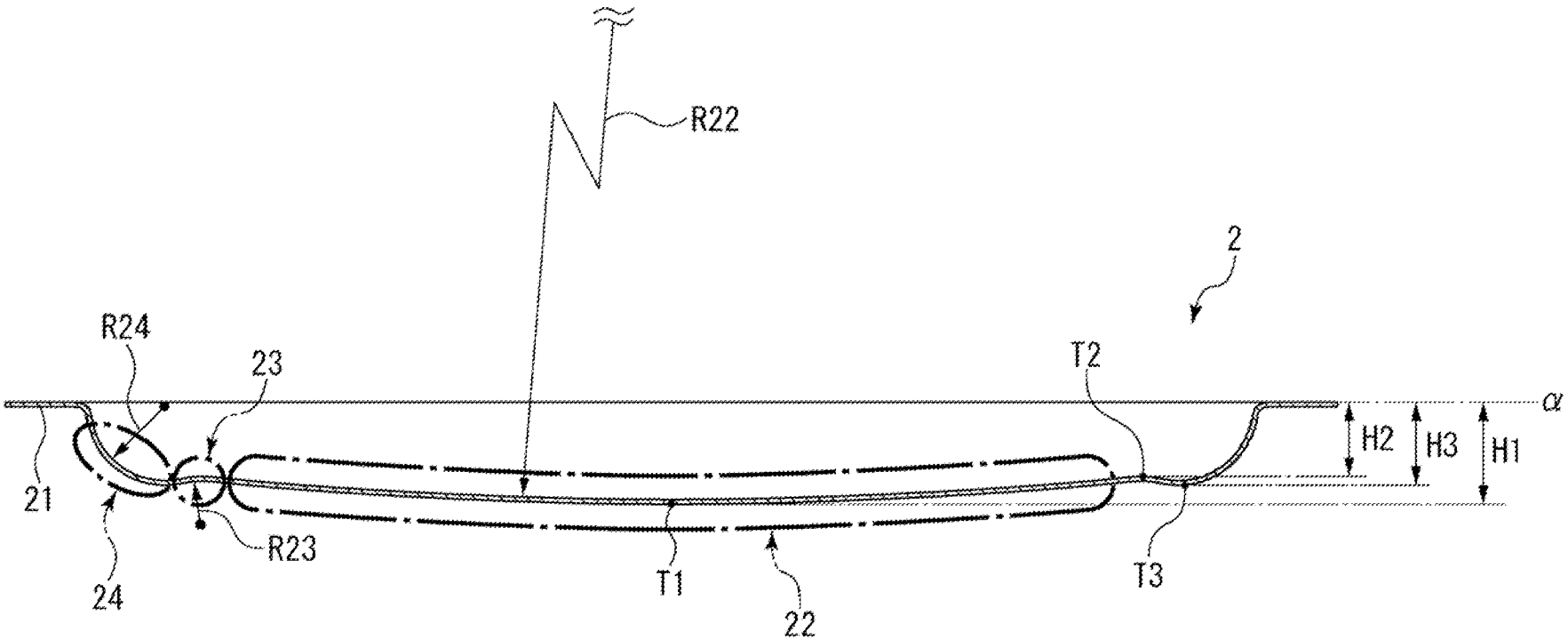
FIG. 3 is a cross-sectional view illustrating the structure of one diaphragm in the embodiment of the present invention.
Figure 4:
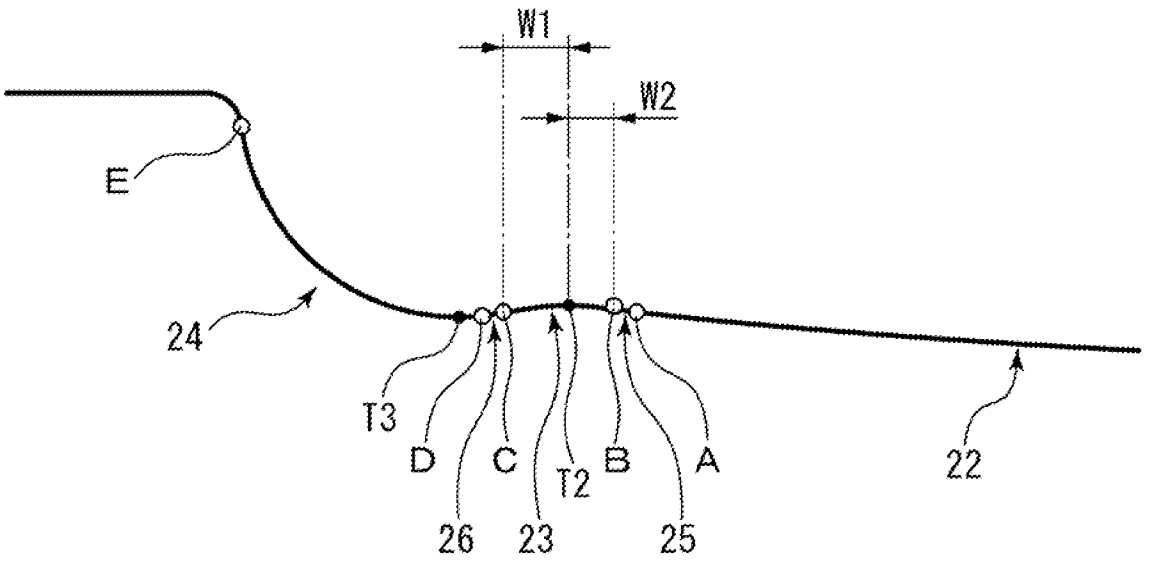
FIG. 4 is a partially enlarged cross-sectional view illustrating the structure of the diaphragm under low pressure surroundings.

As illustrated in FIGS. 3 and 4, the diaphragm 2 mainly includes, in addition to the aforementioned annular connection end portion 21, a third curved portion 24 continuously formed at the radially inward side of the connection end portion 21, a first curved portion 22 disposed in the center of the diaphragm 2 (at the radially inward side), a second curved portion 23 located between the third curved portion 24 and the first curved portion 22, a connection portion 25 located between the first curved portion 22 and the second curved portion 23 and continuously formed with the first curved portion 22 and the second curved portion 23, and a connection portion 26 located between the second curved portion 23 and the third curved portion 24 and continuously formed with the second curved portion 23 and the third curved portion 24.

The first curved portion 22, the second curved portion 23, and the third curved portion 24 are configured to have respective constant curvatures. The first curved portion 22 is formed to protrude toward the outer side of the diaphragm 2 (or toward the fuel chamber 11 in FIG. 1), i.e., formed to be bulged out. The second curved portion 23 is formed to protrude toward the inner side of the diaphragm 2 (or toward the enclosed space), i.e., formed to be dented in. The third curved portion 24 is formed to protrude toward the outer side of the diaphragm 2, i.e., formed to be bulged out.

In the present embodiment, as illustrated in FIG. 4, the first curved portion 22 corresponds to a portion having the constant curvature at the radially inward side from a boundary (A) between the first curved portion 22 and the connection portion 25. The second curved portion 23 corresponds to a portion having the constant curvature between a boundary B and a boundary C, the boundary B being between the second curved portion 23 and the connection portion 25, the boundary C being between the second curved portion and the connection portion 26. The third curved portion 24 corresponds to a portion having the constant curvature between a boundary D and a boundary E, the boundary D being between the third curved portion 24 and the connection portion 26, the boundary E being between the third curved portion 24 and the connection end portion 21. Though not illustrated in detail, the connection portion 25 is formed in a curved surface shape having a curvature radius greater than the curvature radii of the first curved portion 22 and the second curved portion 23 that are continuously formed with an end portion of the connection portion 25, and the connection portion 26 is formed in a curved surface shape having a curvature radius greater than the curvature radii of the second curved portion 23 and the third curved portion 24 that are continuously formed with an end portion of the connection portion 26.

In addition, the first curved portion 22, the second curved portion 23, and the third curved portion 24 are connected via the connection portion 25 and the connection portion 26 that are formed in the aforementioned shapes, i.e., curved wall shapes but are not limited thereto. Alternatively, the first curved portion 22, the second curved portion 23, and the third curved portion 24 may be connected via linear or substantially S-shaped connection portions or may be directly connected with each other not via the connection portion 25 and the connection portion 26.

As illustrated in FIG. 4, the first curved portion 22 is formed in a dome shape curved to protrude outward in the center of the diaphragm 2. The radially outward side of the first curved portion 22 is continuously formed via the connection portion 25 with the second curved portion 23. The first curved portion 22 is a continuously curved wall part having the constant curvature radius; therefore, when fuel pressure substantially equally acts on an outer surface of the first curved portion 22, the first curved portion 22 is easily deformed without being bent in the middle.

Further, as illustrated in FIG. 3, the first curved portion 22 is constituted by a curved wall part which is formed such that an amount H1 of outward protrusion of the curved wall part at the center shown by a point T1 is greater, at low pressure state, than an amount H3 of outward protrusion of a curved wall part forming the third curved portion 24 at a point T3 defining the longest distance from the second curved portion to the connection end portion 21 in the axial direction (i.e., H1>H3), the point T1 defining the longest distance from the first curved portion 22 to the connection end portion 21 in the axial direction. Furthermore, the curvature radius R22 of the first curved portion 22 is greater than the curvature radius R24 of the third curved portion 24 (i.e., R22>R24).

As illustrated in FIGS. 3 and 4, the second curved portion 23 is constituted by a curved wall part which is formed to be dented in. That is, the second curved portion 23 configures a recess curved to be recessed inward. The radially inward side of the second curved portion 23 is continuously formed via the connection portion 25 with the first curved portion 22 and the radially outward side of the second curved portion 23 is continuously formed via the connection portion 26 with the third curved portion 24. Moreover, the curvature radius R23 of the second curved portion 23 is smaller than the curvature radius R24 of the third curved portion 24 (i.e., R23<R24).

As illustrated in FIGS. 3 and 4, the third curved portion 24 is constituted by a curved wall part formed to be bulged out. That is, the third curved portion 24 configures an annular protrusion disposed at the radially outward side of the diaphragm 2 and curved in a substantially circular arc shape to protrude outward (i.e., toward the fuel chamber 11 in FIG. 1). Further, the radially outward side of the third curved portion 24 is continuously formed with the connection end portion 21 and the radially inward side of the third curved portion 24 is continuously formed via the connection portion 26 with the second curved portion 23. Furthermore, the curvature radius R24 of the third curved portion 24 is greater than the curvature radius R23 of the second curved portion 23 and is smaller than the curvature radius R22 of the first curved portion 22 (i.e., R23<R24<R22).

Next, the pulsation absorption of the metal diaphragm damper 1 under the fuel pressure associated with pulsation repeating high-pressure and low-pressure will be described with FIG. 5.

Figure 5:
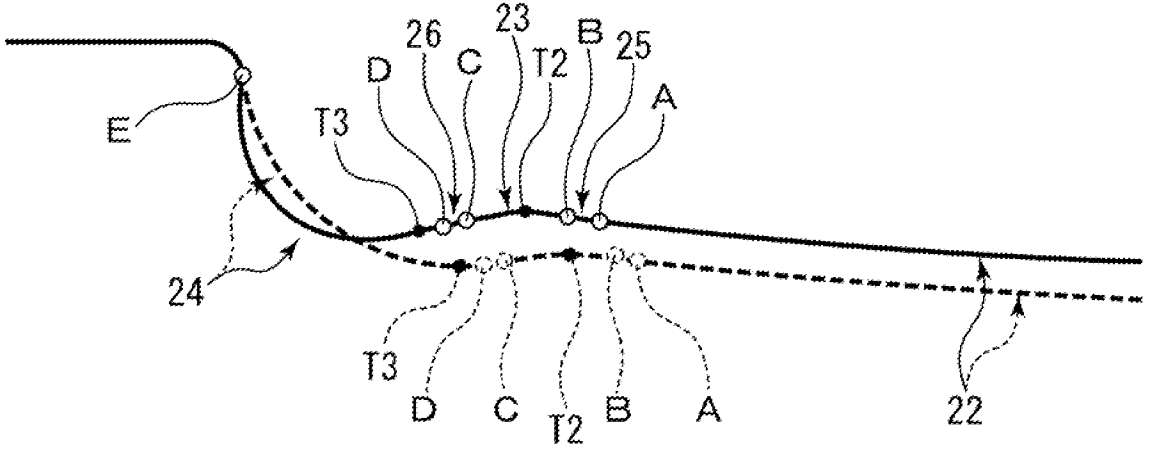
FIG. 5 is a partially enlarged cross-sectional view illustrating the structure of the diaphragm under high pressure surroundings indicated by a solid line and under low pressure surroundings indicated by a broken line.

As illustrated in FIG. 5, the fuel pressure associated with pulsation shifts from low to high and the fuel pressure from the fuel chamber 11 is applied to the diaphragm 2. At this time, firstly, the first curved portion 22 formed in the dorm shape having the large curvature radius and small rigidity is mainly deformed. In addition, the first curved portion 22 is crushed inward, and thus the gas in the metal diaphragm damper 1 is compressed.

Specifically, the first curved portion 22 is deformed axially (i.e., toward the inner side of the diaphragm 2) by the fuel pressure that is external pressure and, at the same time, is deformed to expand radially outward. In other words, the boundary (A) that corresponds to a radially outward end portion of the first curved portion 22 moves radially outward. Stress acting radially outward is applied by the radially outward movement of the boundary A to a portion of the diaphragm 2 located radially outward of the boundary A.

The third curved portion 24 is deformed by the stress acting radially outward so as to be compressed radially outward; therefore, the axial stress applied by external pressure to the first curved portion 22 is converted into the radially outward stress and the third curved portion 24 is deformed such that the curvature radius thereof is reduced. Consequently, the axial stress applied to the first curved portion 22 is absorbed, and thus the diaphragm 2 can be effectively prevented from being fractured.

Specifically, the radially outward stress applied to a portion of the diaphragm 2 located radially outward of the boundary A is transmitted along the outer or inner surface of the diaphragm 2. The second curved portion 23 is constituted by the curved wall part dented in; therefore, the stress also acts axially inward of the diaphragm 2 in such a manner as to, at the radially inward of a point T2 of the second curved portion 23, be guided via the connection portion 25 in accordance with the shape of the second curved portion 23, the point T2 defining the shortest distance from the second curved portion to the connection end portion in the axial direction. Accordingly, as illustrated in FIG. 5, the second curved portion 23 is deformed by the force acting axially inward and the radially outward stress such that the point T2 moves axially inward of the diaphragm 2 and radially outward.

As just described, the second curved portion 23 is deformed such that the point T2 moves axially inward of the diaphragm 2 and radially outward, and thus not only the radially outward stress but also the force pulling axially inward of the diaphragm 2 acts radially inward from the point T3 of the third curved portion 24 continuously formed via the connection portion 26 with the second curved portion 23. Therefore, as illustrated in FIG. 5, the third curved portion 24 is pulled axially inward of the diaphragm 2 and radially inward from the point T3, and thus the boundary D that is a radially inward end portion of the third curved portion 24 is brought into a position inward of the diaphragm 2 compared with in a case where the diaphragm 2 is under low pressure. Accordingly, the radially outward stress acting on the first curved portion 22 is converted into the force to curve the third curved portion 24 inward, and thus part of the radially outward stress is absorbed by the deformation of the third curved portion 24. Consequently, the stress acting on the diaphragm 2 is dispersed, and thus the diaphragm 2 is prevented from being fractured. In particular, the stress can be effectively prevented from concentrating on a location adjacent to the boundary E between the third curved portion 24 and the connection end portion 21.

In addition, the stress acts on the third curved portion so as to reduce the curvature radius of the third curved portion 24; therefore, the third curved portion 24 is not easily reversed. As a result, the diaphragm 2 can be effectively prevented from being fractured.

Subsequently, the fuel pressure associated with pulsation shifts from high to low and thus the fuel pressure applied from the fuel chamber 11 to the diaphragm 2 decreases. At this time, the first curved portion 22 comes to protrude outward of the diaphragm 2 into the dome shape, and then the shape of the diaphragm 2 is restored. Additionally, in response to the restoring force of the first curved portion 22, the shapes of the second curved portion 23 and the third curved portion 24 are restored.

Moreover, the larger the curvature radius is, the more easily deformation occurs. Accordingly, the first curved portion 22 having the largest curvature radius is disposed in the center of the diaphragm 2, and thus a sufficient volume variable region (i.e., a large area of pulsation absorption) can be secured in the center of the diaphragm 2. Note that the radially inward distance between the points T2, opposite to each other over the center of the diaphragm 2, of the curved wall part of the second curved portion 23 is formed to be larger than the radially outward distance from each of the points T2 to a radially outward end portion (i.e., the boundary E) of the third curved portion 24. In other words, the region radially occupied by the first curved portion 22 is formed to be larger than the region radially occupied by the third curved portion 24. Thus, the first curved portion 22 functions as the volume variable region and the third curved portion 24 functions as a stress absorption region. Accordingly, the radial dimension of the first curved portion 22 is designed to be larger than the radial dimension of the third curved portion 24; therefore, the large volume variable region can be secured. Additionally, since the first curved portion 22 is formed in a curved shape protruding outward, i.e., is formed to be bulged out, the first curved portion 22 is not easily reversed by external force.

Further, the diaphragm 2 includes from the radially inward side: the first curved portion 22 formed to be bulged out; the second curved portion 23 formed to be dented in; and the third curved portion 24 formed to be bulged out and thus is configured to be curved outward, inward, and outward. Accordingly, when the radially outward stress acts on the diaphragm 2 under external force, the diaphragm 2 deforms while keeping the shape curved outward, inward, and outward. As a result, portions of the diaphragms 2, which are respectively located between the first curved portion 22 and the second curved portion 23 and between the second curved portion 23 and the third curved portion 24 are not easily reversed.

Furthermore, as described above, the curvature radius R23 of the second curved portion 23 is formed to be smaller than the curvature radius R24 of the third curved portion 24; therefore, the third curved portion 24 can be easily deformed radially outward and the second curved portion 23 having the inward curved surface can be inhibited from being axially and largely deformed. Accordingly, the second curved portions 23 of the diaphragms 2, 3 located opposed to each other are prevented from being brought into contact with each other, and thus the diaphragms 2, 3 can be prevented from being fractured.

In addition, the diaphragm 2 is formed such that a distance H2 (see FIG. 3) from the point T2 of the second curved portion 23 to a connection plane of between the connection end portions 21 of the diaphragms 2, 3 (shown by an imaginary line α) of the diaphragm 2 is larger than the maximum amount of deformation of the first curved portion 22. Specifically, the dimensional relationship is established in such a way that "the length obtained by subtracting the maximum amount of axial deformation AMAX (not illustrated) of the first curved portion 22 from a distance H1 (see FIG. 3) from the point T1 of the first curved portion 22 to the connection plane of between the connection end portions 21 of the diaphragms 2, 3 is larger than the distance H2 from the point T2 of the second curved portion 23 to the connection plane of between the connection end portions 21 of the diaphragms 2, 3 (i.e., H1−ΔMAX>H2)". With such a dimensional relationship, even when the second curved portions 23 of the respective diaphragms 2, 3 located opposed to each other are maximally deformed, the points T2 of the respective second curved portions 23 are not brought into contact with each other, and thus both the diaphragms 2, 3 can be prevented from being fractured.

Further, as illustrated in FIG. 4, a radial distance W1 from the point T2 of the second curved portion 23 to the boundary C that is a radially outward end portion of the second curved portion 23 is formed to be larger than a radial distance W2 from the point T2 to the boundary B that is a radially inward end portion of the second curved portion 23 (i.e., W1>W2). With such a dimensional relationship, the second curved portion 23 is axially deformed by stress easily at the radially inward side compared with the radially outward side, and a portion of the radially inward side of the second curved portion 23 functions as the volume variable region together with the first curved portion 22. Therefore, the large volume variable region of the diaphragm 2 can be secured.

Furthermore, as illustrated in FIG. 3, the distance H1 from the point T1 of the first curved portion 22 to the connection plane of between the connection end portions 21 of the diaphragms 2, 3 is set to be larger than the distance H3 from the point T3 of the third curved portion 24 to the connection plane of between the connection end portions 21 of the diaphragms 2, 3 (i.e., H1>H3). With such a dimensional relationship, the large volume variable region of the diaphragm 2 can be secured with respect to the axial dimension of the diaphragm 2.

The deformable portion 19 is formed such that the area radially inward of the point T2 of the second curved portion 23 is larger than the area radially outward of the point T2 of the second curved portion 23; therefore, the large volume variable region of the diaphragm 2 can be secured.

As described above, the embodiment of the present invention is described with the drawings; however, the concrete structure is not limited to the embodiment. Even modifications or additions may be made to the present invention without departing from the scope of the present invention.

For example, in the foregoing embodiment, a case where the diaphragms 2, 3 are connected by laser welding is described, but not limited thereto. Alternatively, as long as the diaphragms 2, 3 can include an enclosed space therebetween, the diaphragms 2, 3 may be connected by a variety of welding methods such as swaging, friction stir welding, and the like.

Further, in the foregoing embodiment, the relationship between the curvature radii of the first curved portion 22, the second curved portion 23, and the third curved portion 24 is described in such a way that the curvature radius R22 of the first curved portion 22 is greater than the curvature radius R24 of the third curved portion 24 and the curvature radius R24 of the third curved portion 24 is greater than the curvature radius R23 of the second curved portion 23, but not limited thereto. Alternatively, for example, the first curved portion 22 and the third curved portion 24 may have the same curvature radius.

Furthermore, as long as the first curved portion 22 and the third curved portion 24 are formed to be bulged out and the second curved portion 23 is formed to be dented in, the radially outward stress can be converted into the force to bend the third curved portion 24 inward. Therefore, for example, the curvature radius of the second curved portion 23 may be greater than the curvature radius of the third curved portion 24.

Additionally, in the foregoing embodiment, the second curved portion 23 is formed by the curved wall part having the constant curvature radius to be dented in, but not limited thereto. Alternatively, the second curved portion 23 may be formed in a waved shape such that the waved shape includes, for example, two or more inward curved wall parts formed to be dented in and such that the inward curved wall part located at the most radially outward side is continuously formed with the third curved portion 24.

Further, in the foregoing embodiment, the first curved portion 22 is formed by the curved wall part having the constant curvature radius. Alternatively, the first curved portion 22 may be formed by, for example, two or more curved wall parts which is formed to bulged out and which has different curvature radii. Additionally, likewise, each of the second curved portion 23 and the third curved portion 24 may be formed similarly to the aforesaid modification of the first curved portion 22.

Further, the diaphragm 2 and the diaphragm 3 may not have the same shape.

Figure 6:
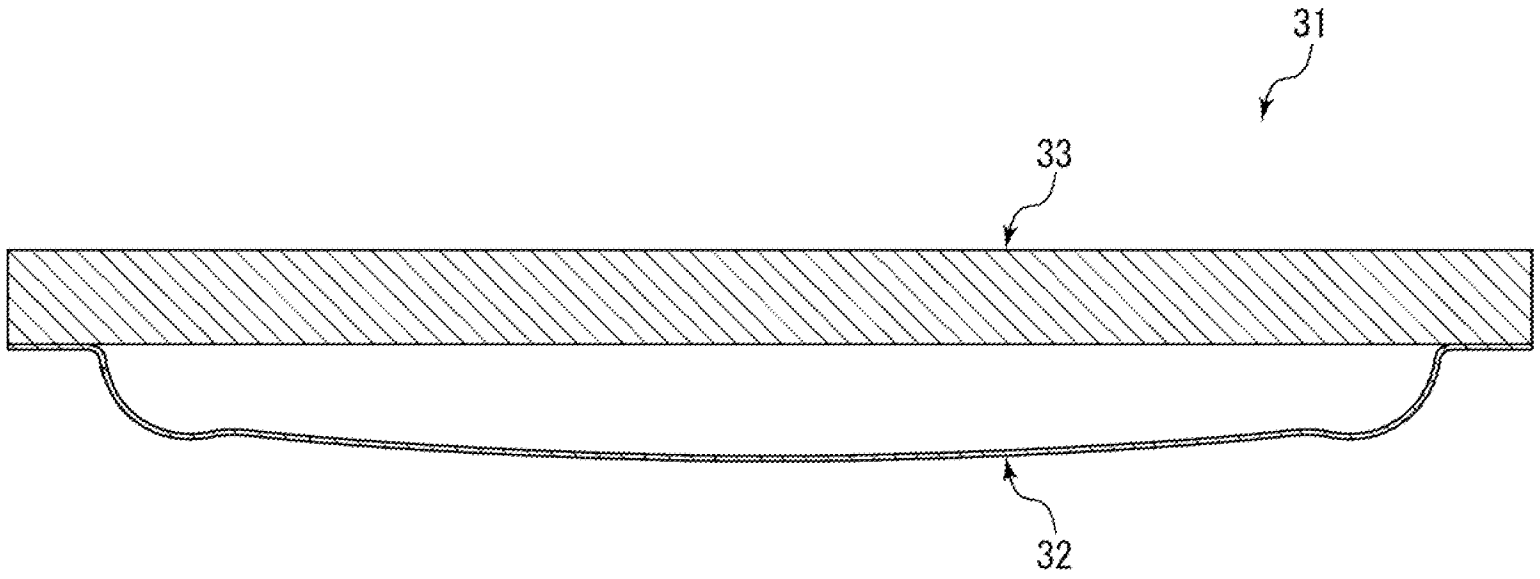
FIG. 6 is a cross-sectional view illustrating a modified example of the metal diaphragm damper.
Figure 7:
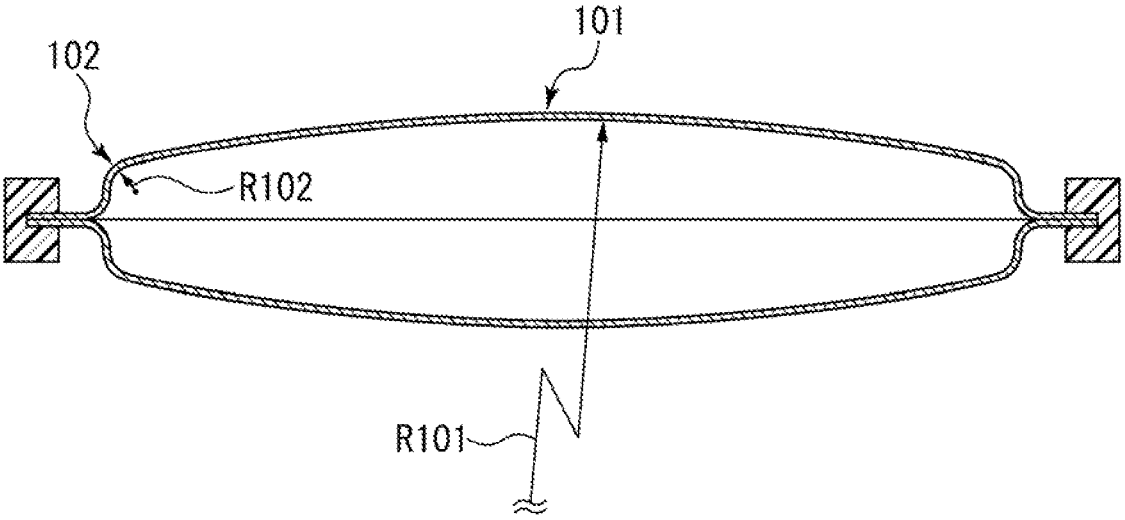
Fig. 7 PRIOR ART
FIG. 7 illustrates a conventional metal diaphragm damper.
Figure 7:
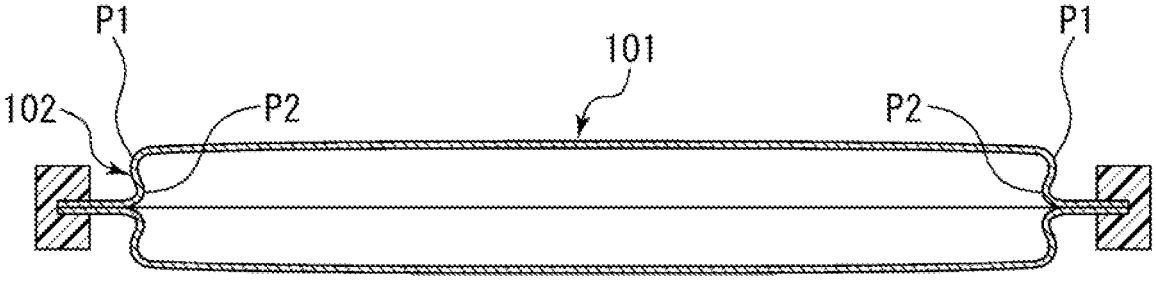
Fig. 7 PRIOR ART

Furthermore, in the foregoing embodiment, the metal diaphragm damper 1 including the diaphragm 2 and the diaphragm 3 connected to each other is configured such that the fuel pressure in the fuel chamber 11 is absorbed by both the diaphragm 2 and the diaphragm 3, but not limited thereto. Alternatively, for example, as illustrated in FIG. 6, a disk-shaped diaphragm 32 and a plate-shaped base member 33 are connected to each other in an airtight manner entirely around the outer circumferential rim. Such a metal diaphragm damper 31 is fixed to an upper wall partially defining the fuel chamber 11 and is applied to absorb fuel pressure in the fuel chamber 11 by only one diaphragm i.e., the diaphragm 32.

Moreover, in the foregoing embodiment, the metal diaphragm damper 1 is provided in the fuel chamber 11 of the high-pressure fuel pump 10 and is configured to reduce pulsation in the fuel chamber 11, but not limited thereto. Alternatively, the metal diaphragm damper 1 is provided in a fuel pipe or the like connected to the high-pressure fuel pump 10 and thus may reduce pulsation.

Further, as long as airtightness and connection strength can be maintained, at least only the radially outermost parts of the connection end portions 21 of the diaphragm 2 and the diaphragm 3 may be connected to each other.

Furthermore, a core member made of an elastically deformable synthetic resin or the like may be disposed in the enclosed space formed between the diaphragm 2 and the diaphragm 3 connected to each other (i.e., inside of the metal diaphragm damper 1), and thus the diaphragm 2 and the diaphragm 3 may be prevented from being brought into contact with each other under high pressure.

REFERENCE SIGNS LIST

1 Metal diaphragm damper
2, 3 Diaphragm
10 High-pressure fuel pump
11 Fuel chamber
12 Plunger
13 Suction valve
14 Pressurizing chamber
15 Discharge valve
19 Deformable portion
20 Outer circumferential fixation portion
21 Connection end portion
22 First curved portion
23 Second curved portion
24 Third curved portion
25, 26 Connection portion
31 Metal diaphragm damper
32 Diaphragm
33 Base member
A to D Boundary
R22 to R24 Curvature radius
T1 to T3 Point
W1 to W2 Distance
α Imaginary line

The invention claimed is:

1. A metal diaphragm damper, comprising:

a diaphragm constituted by a deformable portion disposed in a center thereof and an outer circumferential fixation portion formed by an outer circumferential rim of the diaphragm, the metal diaphragm damper being filled with gas inside and formed in a disk shape, wherein the deformable portion is constituted by a third curved portion located at a radially outward side and formed to be bulged out in a slant direction between an axial direction and a radial direction, a first curved portion located radially inward of the third curved portion and formed to be bulged out in the axial direction, and a second curved portion located between the first curved portion and the third curved portion, and formed to be dented in, in the axial direction;

the outer circumferential fixation portion, the third curved portion, the second curved portion and the first curved portion are continuously formed from a radially outside toward a radially inside, and in a cross section of the diaphragm inclusive of and parallel to a center axis of the diaphragm, a distance (H1) from a point (T1) of the first curved portion to an axially end surface of the circumferential fixation portion in the axial direction is larger than a distance (H3) from a point (T3) of the third curved portion to the axially end surface of the circumferential fixation portion.

2. The metal diaphragm damper according to claim 1, further comprising a base member disposed so as to face an inner surface of the diaphragm, wherein the base member and the diaphragm are connected to each other in an airtight manner entirely around circumferences thereof.

3. The metal diaphragm damper according to claim 1, wherein of the second curved portion is formed so as to have a curvature radius smaller than a curvature radius of a curved wall part forming the third curved portion.

4. The metal diaphragm damper according to claim 1, wherein the diaphragm is connected to another diaphragm such that the metal diaphragm damper is constituted by a pair of diaphragms having an identical shape and reversely oriented to each other, and outer circumferential rims of the diaphragms are fixed to each other so as to form the outer circumferential fixation portion.

5. The metal diaphragm damper according to claim 1, wherein a radially inward distance between a point of the second curved portion and another point of the second curved portion opposite to each other over a center of the diaphragms is larger than a radial distance from each of the points of the second curved portion to a radially outward end of the third curved portion.

6. The metal diaphragm damper according to claim 2, wherein of the second curved portion is formed so as to have a curvature radius smaller than a curvature radius of a curved wall part forming the third curved portion.

7. The metal diaphragm damper according to claim 2, wherein the diaphragm is connected to another diaphragm such that the metal diaphragm damper is constituted by a pair of diaphragms having an identical shape and reversely oriented to each other, and outer circumferential rims of the diaphragms are fixed to each other so as to form the outer circumferential fixation portion.

8. The metal diaphragm damper according to claim 2, wherein a radially inward distance between a point of the second curved portion and another point of the second curved portion opposite to each other over a center of the diaphragms is larger than a radial distance from each of the points of the second curved portion to a radially outward end of the third curved portion.

9. The metal diaphragm damper according to claim 3, wherein the diaphragm is connected to another diaphragm such that the metal diaphragm damper is constituted by a pair of diaphragms having an identical shape and reversely oriented to each other, and outer circumferential rims of the diaphragms are fixed to each other so as to form the outer circumferential fixation portion.

10. The metal diaphragm damper according to claim 3, wherein a radially inward distance between the point of a second curved portion and another point of the second curved portion opposite to each other over a center of the diaphragms is larger than a radial distance from each of the points of the second curved portion to a radially outward end of the third curved portion.

11. The metal diaphragm damper according to claim 4, wherein a radially inward distance between the point of a second curved portion and another point of the second curved portion opposite to each other over a center of the diaphragms is larger than a radial distance from each of the points of the second curved portion to a radially outward end of the third curved portion.

12. The metal diaphragm damper according to claim 4, wherein further comprising a core member of an elastically deformable material disposed in an enclosed space formed between the diaphragms.

13. The metal diaphragm damper according to claim 7, further comprising a core member of an elastically deformable material disposed in an enclosed space formed between the diaphragms.

14. The metal diaphragm damper according to claim 9, further comprising a core member of an elastically deformable material disposed in an enclosed space formed between the diaphragms.

* * * * *